United States Patent [19]

Levaillant

[11] 3,949,328

[45] Apr. 6, 1976

[54] VARIABLE-REFLECTIVITY DEVICE FOR VARYING OUTPUT POWER OF MICROWAVE GENERATOR

[75] Inventor: Claude Levaillant, Paris, France

[73] Assignee: C.G.R.-MeV, France

[22] Filed: Mar. 20, 1975

[21] Appl. No.: 560,239

[30] Foreign Application Priority Data

Mar. 22, 1974 France ..... 74.09848

[52] U.S. Cl. ..... 333/81 B; 331/182

[51] Int. Cl.[2] ..... H01P 1/22

[58] Field of Search ..... 333/81 B; 331/106, 109, 331/182

[56] References Cited

UNITED STATES PATENTS

| | | | |
|---|---|---|---|
| 2,634,331 | 4/1953 | Honda | 333/81 B |
| 3,784,777 | 1/1974 | Soulier | 333/81 B X |

*Primary Examiner*—Paul L. Gensler

*Attorney, Agent, or Firm*—Cushman, Darby & Cushman

[57] ABSTRACT

A microwave reflector device of small size, making it possible to deliver a predetermined quantity of the power generated by a high-power microwave generator, comprises a unidirectional element which imposes an appropriate constant load on the generator, and a reflector system constituted by a waveguide D tapped into the output waveguide T of the unidirectional element, said waveguide D being terminated at its free end by a metal plate carrying three quartz rods 10, 11, 12 designed to slide, parallel to the axis of the waveguide D, respectively in three metallic sleeves 13, 14, 15 having a circular shape and dimensioins such that they form cut-off waveguides at the operating frequency of the generator. The free end of each of the sleeves 13, 14, 15 provided with three respective rings 16, 17, 18 of absorber material.

8 Claims, 4 Drawing Figures

VARIABLE-REFLECTIVITY DEVICE FOR VARYING OUTPUT POWER OF MICROWAVE GENERATOR

The present invention relates to a variable-reflectivity microwave device which makes it possible to vary the power delivered by a microwave generator of the klystron or magnetron kind for example.

In fact, it is possible to modify the H.F. power of a generator by varying the continuous power which is applied to it or again by arranging a variable attenuator at its output. This latter solution also has the advantage of enabling the generator to operate at constant power. However, these attenuators are bulky when designed for high-power operation.

The device in accordance with the invention can be used at the outputs of power oscillators operating at constant power.

In accordance with the invention, a microwave reflector device which makes it possible to deliver a predetermined quantity of the power furnished by a microwave generator, comprises a unidirectional transmission element and a reflector system, said reflector system comprising a waveguide D of rectangular section, tapped into one of the sides of a waveguide T arranged at the output of said unidirectional element; the free end of said waveguide D being terminated by a metal plate to which there is attached, perpendicularly thereto, at least one metal sleeve of cylindrical shape in which a piston can displace parallel to the axis of the waveguide D, said piston being made of a dielectric material, said sleeve having an internal diameter such that at the operating frequency of the generator, it forms a cut-off waveguide.

The invention may best be understood from the following detailed description thereof, having reference to the accompanying drawings, in which.

Figure 1:
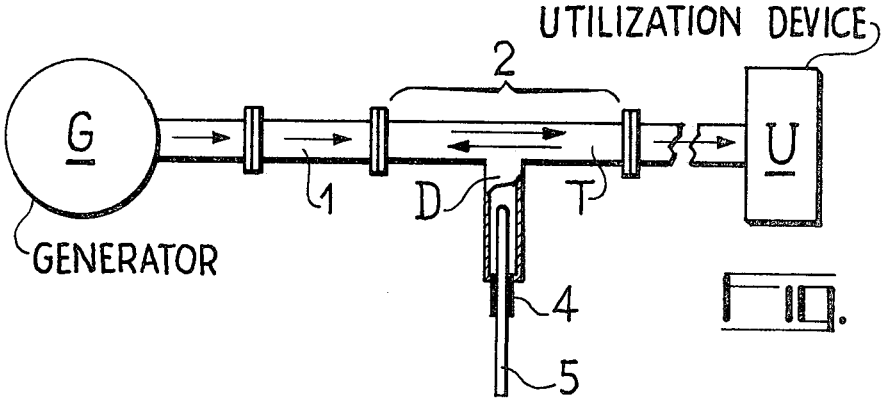
FIG. 1 is a device in accordance with the invention.
Figure 2:
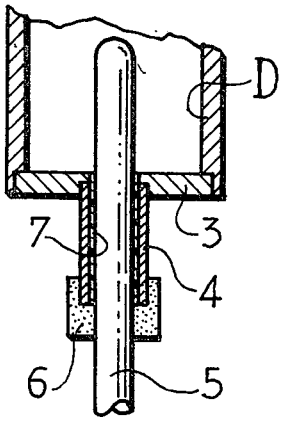
FIG. 2 is a detail of an embodiment of a device in accordance with the invention.

FIG. 1 schematically illustrates a reflector device in accordance with the invention, this device comprising a unidirectional element 1 and a reflector system 2 constituted by a rectangular section waveguide T and a waveguide D tapped into one of the sides of the waveguide T. In the example shown in FIG. 1, the waveguide D is tapped into the shorter side of the waveguide T, this corresponding to parallel connection. The waveguide D of the reflector system 2 is terminated at its free end, as FIG. 2 shows in detail, by a metal plate 3 to which there is attached, at its centre, a circular section sleeve 4 in which there can slide a dielectric rod 5 of circular section also. The internal diameter of said sleeve 4 is such that it forms a cut-off waveguide at the operating frequency of the device. The end of the sleeve 4 is provided with a ring 6 of an absorber material, graphite for example. In the example shown, the rod 5 is made of quartz but it is also possible to use alumina or polyethylene for example.

In order to ensure that the rod 5 slides properly in the sleeve 4 which is made of metal, the internal wall of the latter can be lined with a film 7 of polytetrafluorethylene (Teflon) or polyethylene-boron.

For example, in an embodiment comprising a generator G operating at a frequency of 3000 MHz and a waveguide D tuned to this frequency (type RG 48 U for example), it is possible to utilise a rod 5 of quartz, 14 mm in diameter, the end of that part which enters the waveguide D having a rounded form. The length of the waveguide D is then around 218 mm whilst the length of the metal sleeve 4 will be 50 mm and that of the ring 6 of absorber material (graphite for example) around 15 mm. In this case, the travel of the quartz rod will be around 210 mm in order to produce a variation from zero reflection to total reflection.

Figure 3:
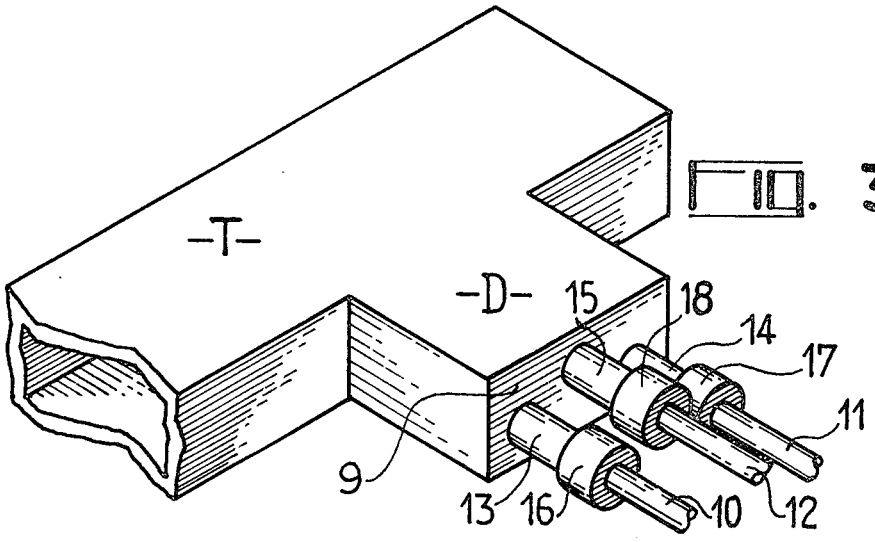

Referring to FIG. 3, in a preferred embodiment of the device in accordance with the invention, the system 2 comprises a waveguide D tapped into the main waveguide T and terminated at its free end by a metal plate 9 to which there are attached three metal sleeves 13, 14, 15 in which there can slide, parallel to the axis of the waveguide D, three respective dielectric rods 10, 11, 12. The internal diameters of these sleeves 13, 14, 15, are such that they form cut-off waveguides at the operating frequency of the device. At the end of each of the three sleeves 13, 14, 15, rings 16, 17 and 18 of an absorber material, are arranged. The metal sleeves 13, 14, 15, as shown in FIG. 4, are arranged at the three corners of an isosceles triangle whose base is parallel to the longer side of the waveguide D (parallel connection).

By way of non-limitative example, at a frequency of 3000 MHz and using a waveguide D equipped with three rods 10, 11, 12 made of quartz, the length of the waveguide D is 148 mm and the travel of the rods 10, 11, 12 is of the order of 100 mm in order to execute a variation ranging from zero reflection to total reflection.

If the waveguide D is attached to the longer side of the waveguide T (series connection), then the size of the reflector system 2 is a little larger. In this case, the length of the waveguide D is around 238 mm when equipped with a single quartz rod, and around 169 mm if equipped with three rods 10, 11, 12 of quartz, the length of travel of these latter, in order to effect a variation from zero reflection to total reflection, being around 210 mm for a single rod and 100 mm in the case of three rods.

Figure 4:
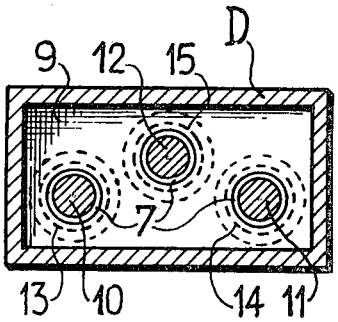
FIGS. 3 and 4 illustrate another embodiment of a device in accordance with the invention.

As in the example shown in FIG. 2, it is possible to line the internal walls of the sleeves 13, 14, 15 shown in FIG. 4, with a film 7 of polytetrafluorethylene or polyethylene-boron.

What I claim is:

1. A microwave reflector device which makes it possible to deliver a predetermined quantity of the power produced by a microwave generator, comprising a unidirectional transmission element and a reflector system, said reflector system comprising a first waveguide of rectangular section, tapped into one of the sides of a waveguide arranged at the output of said unidirectional element, said first waveguide being terminated by a terminal metal plate to which there is fixed, perpendicularly thereto, at least one cylindrical metal sleeve in which there can slide, parallel to the axis of said waveguide, a piston made of a dielectric material, the internal diameter of said sleeve being such that at the operating frequency of the generator the sleeve acts as a circular cut-off waveguide.

2. A device as claimed in claim 1, wherein said terminal plate of said first waveguide contains three metal sleeves in which there can displace three dielectric pistons, said sleeves being arranged at the corners of an isosceles triangle whose base is parallel to the longer sides of the first waveguide.

3. A device as claimed in claim 1, wherein said rod sliding in said sleeve, is made of quartz.

4. A device as claimed in claim 1, wherein the internal walls of said metal sleeves are covered by a film of a dielectric material.

5. A device as claimed in claim 4, wherein said film is of polytetrafluorethylene.

6. A device as claimed in claim 4, wherein said film is of polyethylene-boron.

7. A device as claimed in claim 1, wherein the end of said sleeve is provided with a ring of absorber material.

8. A device as claimed in claim 7, wherein said ring is made of graphite.

* * * * *